United States Patent [19]

Moser et al.

[11] 3,930,895

[45] Jan. 6, 1976

[54] SPECIAL MAGNESIUM-MANGANESE ALUMINUM ALLOY

[75] Inventors: Clarence J. Moser; Wilbur E. Stephens, both of Riverside, Calif.

[73] Assignee: Amax Aluminum Company, Inc., San Mateo, Calif.

[22] Filed: Apr. 24, 1974

[21] Appl. No.: 463,575

[52] U.S. Cl. ..... 148/2; 75/142; 148/11.5 A; 148/32; 164/88

[51] Int. Cl.[2] ..... B22D 21/04; B22D 11/06; C22C 21/04

[58] Field of Search ..... 148/2, 3, 11.5 A, 32, 32.5; 75/138, 142, 147; 164/88

[56] References Cited

UNITED STATES PATENTS

| | | | |
|---|---|---|---|
| 1,928,641 | 10/1933 | Bossert | 75/147 |
| 2,790,216 | 4/1957 | Hunter | 164/88 |
| 3,219,491 | 11/1965 | Anderson et al. | 148/11.5 A |
| 3,219,492 | 11/1965 | Anderson et al. | 148/11.5 A |
| 3,490,955 | 1/1970 | Winter et al. | 75/142 X |
| 3,787,248 | 1/1974 | Setzer et al. | 148/11.5 A |
| 3,802,931 | 4/1974 | Bylund | 148/11.5 A |

*Primary Examiner*—C. Lovell
*Attorney, Agent, or Firm*—Kasper T. Serijan; Eugene J. Kalil

[57] ABSTRACT

A modified type 3004 aluminum alloy is provided characterized by an improved combination of cold workability and physical properties having particular use in the deep drawing of containers, such as beverage cans, and the like, said alloy containing a relatively high level of manganese ranging by weight from about 1.6 to 3 percent. The improvement is particularly apparent in the production of chill cast shapes (sheet metal stock), such as by the continuous casting of the alloy between a pair of water-cooled rolls.

2 Claims, 4 Drawing Figures

SPECIAL MAGNESIUM-MANGANESE ALUMINUM ALLOY

Figure 1:
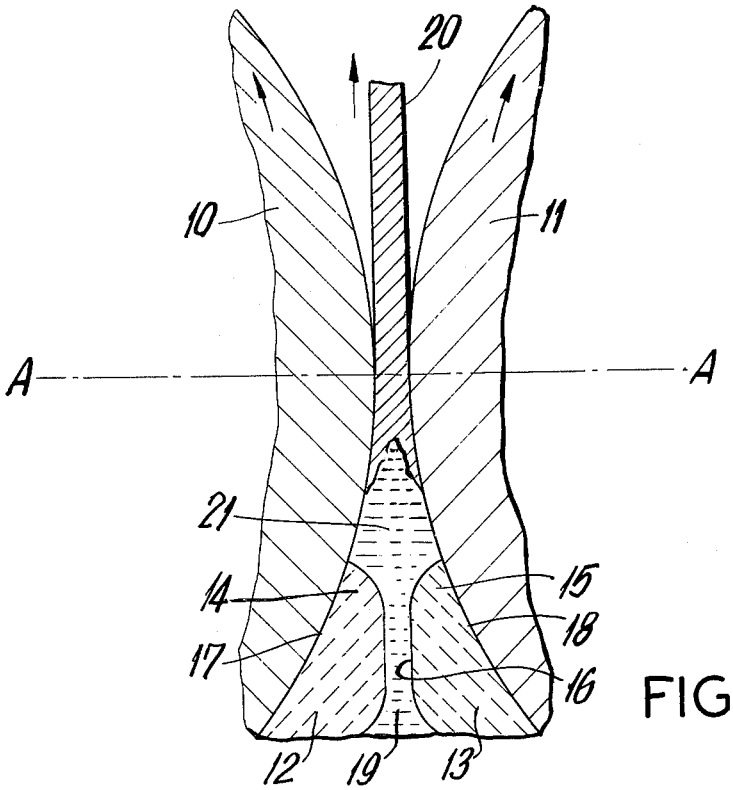

This invention relates to a magnesium-manganese aluminum-base alloy and, in particular, to a modified type 3004 alloy containing about 1.6 to 3 percent by weight of manganese characterized by improved deep drawing characteristics and improved physical properties.

STATE OF THE ART

It is known to produce aluminum sheet metal stock by the continuous casting of aluminum, wherein molten aluminum is caused to flow between a pair of rotating water-cooled rolls and solidify into a flat shape. The chill cast product produced in this manner is thermally homogenized and then reduced in thickness by cold rolling with an intermediate anneal, where necessary, until the desired thickness is obtained. Generally, the sheet product is finished with cold work temper, such as one-half hard, full hard, etc. The sheet metal products are particularly useful in the production of deep drawn and ironed containers, such as beverage cans. A typical alloy employed is one designated as type 3004 having the following nominal composition: 0.3% Si, 0.5% Fe, 0.25% Cu, 1 to 1.5% Mn, 0.8 to 1.3% Mg, 0.25% Zn and the balance essentially aluminum.

A method and apparatus for continuously casting aluminum alloys are described in U.S. Pat. No. 2,790,216 to J. L. Hunter (issued Apr. 30, 1957), the disclosure of which is incorporated herein by reference. The apparatus of the foregoing patent produces a chill cast product (sheet metal stock) which is generally characterized by a uniform microstructure comprising particles of intermetallic compounds, including a compound based on Al-Mn, dispersed through the alloy matrix. Sheet metal stock produced by the foregoing method for subsequent cold rolling to thin gage may typically have a thickness of about ⅛ inch, ¼ inch, ⅜ inch, and the like, and have widths ranging upwards of 24 inches or more. However, before cold rolling the cast sheet metal stock, it is generally homogenized at a temperature of about 950°F to 1050°F for about 8 to 16 hours.

As stated hereinbefore, the chill cast sheet metal stock following homogenization is cold rolled to the desired thickness of, for example, 0.0120 to 0.0145 inch, with intermediate anneals between reductions, where necessary. In the production of beverage cans, circular discs or blanks are cut or punched from a cold worked sheet for deep drawing into the desired shape.

As pointed out on page 162 of the Metals Handbook, Volume 4, entitled "Forming" (8th edition, 1969, American Society of Metals), deep drawing is a process for forming sheet metal between an edge-opposing punch and die to produce a cup or shell-like part. During drawing, the metal is bent over and wrapped around the punch nose, while the outer portions of the blank move radially toward the center of the circular blank until they flow over the die radius as the blank is drawn into the die cavity by the punch. The radial movement of the metal increases the blank thickness as the metal moves toward the die radius. As the metal flows over the die radius, the thickness decreases due to tension in the shell wall between the nose of the punch and the die radius.

Where a deep drawn shell with a heavy bottom and thin sidewalls are desired, ironing may be used in conjunction with deep drawing. The shell is first drawn from a circular blank to approximately the final diameter using a drawing lubricant. The lubricant is thereafter removed and the shell annealed. The sidewalls are then reduced in thickness by, for example, 30 to 40 percent, in an ironing operation. An additional reduction in thickness may be obtained by repeating the cleaning, annealing and ironing steps with good control over wall thickness.

Ironing is an important step in the making of beverage cans to assure a bottom thicker than the side walls. Because of the nature of the working stresses in this operation, and depending on the alloy being worked, seizing, scoring and/or aluminum pick-up may occur on the die surface which adversely affects the quality of the final product produced.

For example, it has been observed that chill cast aluminum alloy 3004 which has been homogenized and cold worked tends to cause seizing at the die surface during deep drawing accompanied by aluminum pick-up on the die. A metallographic examination of the type 3004 alloy produced by the continuous chill-casting method indicated that the particles of the Al-Mn compound were generally extremely fine and had an average particle size not exceeding about 2 microns in diameter. Apparently, the particles were too small to effect a cleaning action on the die which is desirable. On the other hand, the use of aluminum sheets produced from conventionally cast ingots tended to cause die scoring during deep drawing due to the presence of coarse particles. While the coarse particles effectively cleansed the die during deep drawing, they left score marks. A metallographic examination of such sheet material showed that a large number of coarse particles of the Al-Mn compound had a size exceeding about 15 to 20 microns.

A continuously cast metal product is more desirable for working because of the general uniformity of the microstructure, provided the size of the precipitated particles can be controlled.

OBJECTS OF THE INVENTION

It is an object of the invention to provide a continuously cast aluminum product characterized by improved working properties, particularly sheet stock material suitable for use in making deep drawing blanks.

Another object is to provide a sheet material or blank of an aluminum alloy capable of being deep drawn and ironed into containers, such as beverage cans.

A further object is to provide an aluminum alloy composition, e.g. modified type 3004 alloy, characterized by an improved metallographic structure in the chill cast condition.

Another object is to provide a method for improving the deep drawing properties of a magnesium-manganese aluminum-base alloy, wherein the alloy is characterized by an improved metallographic structure.

These and other objects will more clearly appear from the following disclosure and the accompanying drawing, wherein:

FIG. 1 is a fragmentary view in cross section showing adjacent portions of water-cooled rolls in conjunction with a portion of a nozzle disposed between the rolls, and illustrating the manner in which a molten aluminum alloy flows from the nozzle tip and solidifies as it passes between the rolls as described in U.S. Pat. No. 2,790,216.

Figure 4:
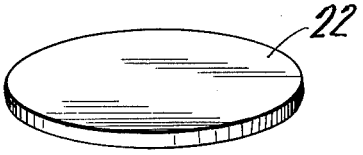
Figure 2:
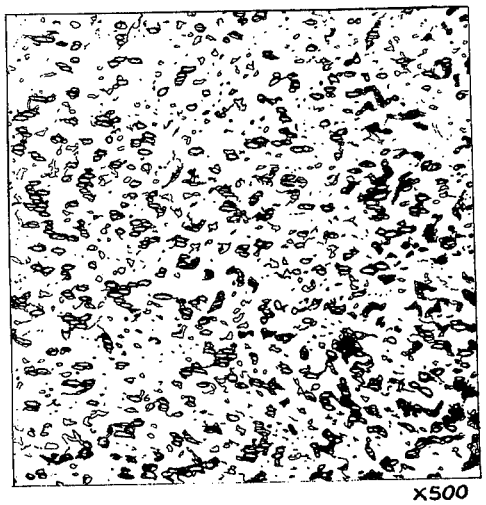
Figure 3:
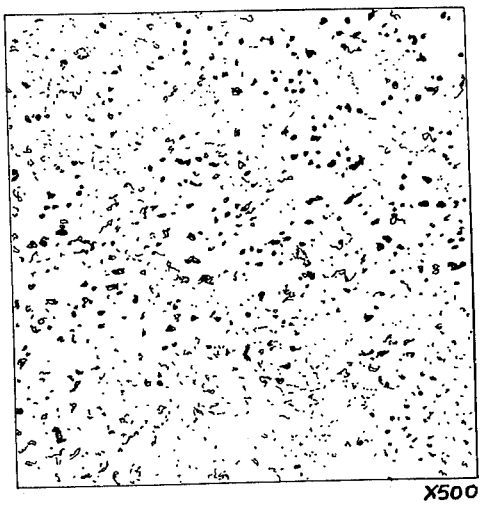

FIGS. 2 and 3 are representative of photomicrographs showing the difference between the microstructure of a chilled cast aluminum alloy containing a relatively high amount by weight of about 2.3% manganese (FIG. 2) and of substantially the same alloy containing a lower amount of manganese of about 1.2% (FIG. 3) both taken at 500 times magnification; and FIG. 4 is illustrative of a circular blank for deep drawing into a shell, such as a beverage can.

SUMMARY OF THE INVENTION

Stating it broadly, one embodiment of the invention is directed to a method of improving the deep drawability of a type 3004 alloy in the production of food containers, such as beverage cans, the method residing in adjusting the manganese content of substantially a type 3004 alloy to a relatively high level by weight of over about 1.6 to 3 percent (preferably about 2 to 3 percent), melting the alloy and then chill casting said alloy into a flat shape for use in making sheet metal products, the matrix of said shape following homogenization and air cooling being characterized metallographically by a microstructure comprising a dispersion of particles of an intermetallic compound containing Al and Mn ranging in average size or diameter from about 4 to 12 microns.

The invention also provides as an article of manufacture a wrought deep drawing blank of the foregoing composition, preferably a cold worked blank.

As stated above, the high manganese aluminum alloy is characterized by an improved combination of deep drawing and physical properties, especially where the alloy is produced by chill casting, e.g. continuous chill casting. The alloy ranges in composition by weight from about 0.1 to 0.3% Si, about 0.25 to 0.8% Fe, about 0.10 to 0.25% Cu, about 0.75 to 1.25% Mg, about 1.6 to 3% Mn and the balance essentially aluminum.

By employing a relatively high level of manganese in the alloy (modified 3004 alloy), an improved metallographic structure is obtained when the alloy is chill cast and homogenized such that deep drawing blanks produced from the sheet metal stock are characterized by markedly improved deep drawing properties as evidenced by a decrease in seizing and metal pick-up at the die surface during die forming and ironing on an aluminum blank.

Observations indicate that the foregoing improvement appears to be related to the microstructure of the sheet metal stock. For example, where the amount of manganese added to the alloy is less than 1.5 percent by weight, e.g. 1.2 percent, a rather fine microstructure is obtained in which dispersed particles of Al-Mn compound have an average size below 2 microns and generally below 1 micron.

It has been found that when the amount of manganese in the alloy exceeds 1.6 percent by weight and ranges up to about 3 percent (e.g. about 2.3 percent), the dispersed particles are coarser, with a majority of the particles ranging in size from about 6 to 12 microns. This type of microstructure provides improved deep drawing properties in which very little seizing and metal pick-up occur.

As stated above, the composition is particularly useful in the production of sheet metal stock made by continuous casting, such as described in U.S. Pat. No. 2,790,216. A fragmented representation of this method is shown in FIG. 1 of the drawing herein which shows a sectional view of the roll section where the casting of the metal actually takes place. The assembly in the drawing shows portions of rolls 10, 11 in spaced-apart relation at their closest position of approach along axis A—A, roll 11 rotating clockwise and roll 10 counterclockwise. The rolls are water-cooled by means not shown, reference being made to U.S. Pat. No. 2,790,216 for such details.

Disposed between the rolls is a pair of nozzle blocks 12 and 13 made of ceramic, each of the blocks tapering upwardly to provide nozzle tips, 14, 15. The blocks are separated near the tips to provide a throat 16 through which molten metal of aluminum is fed from a chamber below embraced by the nozzle blocks.

The nozzle blocks are designed to conform to the rolls at their contacting surfaces 17, 18 to prevent back flow of metal between the nozzle tips and the rolls, particularly during the starting period. A forced bearing contact is not required. For example, a clearance of from about 0.005 to 0.15 and more may be employed, depending upon the metal being cast.

Molten aluminum 19 is caused to flow upwardly from the chamber in the lower portion of the assembled nozzle blocks (not shown) through throat 16 where the cooling effect of the water-cooled rolls causes the metal to freeze as it approaches the bite of the rolls shown bisecting axis A—A. The flow of metal is controlled so that it is free of turbulence. This results in a uniform rate of extraction of heat from the metal so that the build-up of solidified metal on the surface of the rolls is particularly uniform. Thus, solid metal 20 has formed by the time the metal passes through the bite of the rolls, a reservoir of molten metal reaching a steady state in the region 21 below the solidified metal.

The foregoing method of casting results in a crystal structure (microstructure) in the chill cast product which is uniform. The cast product may be worked in a manner to develop its strength to the fullest extent and a final product of substantially uniform high quality obtained. The flat product or sheet metal stock produced may have a nominal thickness of about ¼ inch and a width of about 24 inches.

We have observed that by controlling the manganese content to a relatively high level of, for example, about 2.3 percent by weight and chill casting the alloy, a more useful microstructure is obtained in terms of particle size and uniformity of microstructure following homogenization which enables the deep drawing of beverage cans with less seizing and metal pick-up on the die; whereas, when the alloy is lower in manganese content, e.g. below 1.5 percent, the opposite is true.

The difference in microstructures between the two will be apparent by referring to FIG. 2 and FIG. 3. As will be noted from FIG. 2, the majority of the particle sizes ranges from about 4 to 12 microns; whereas, the alloy illustrated by FIG. 3 shows a much finer particle size of below 2 microns of the majority of the particles. Tests have shown that the particle size of FIG. 2 is preferred for deep drawing purposes.

As has been stated earlier, after the sheet metal stock has been produced by continuous casting and homogenized, it is rolled with or without intermediate annealing to the desired gage, for example, to a gage of about 0.012 to 0.0145 inch. The final wrought sheet is preferably in the cold worked state and blanks are produced therefrom. A typical blank 22 is shown in FIG. 4 as a circular disc for deep drawing into cup-like shells, such as beverage cans.

A typical example of the alloy of the invention is one containing 0.3% Si, 0.5% Fe, 0.25% Cu, 2.3% Mn, 1% Mg, 0.25% Zn and the balance essentially aluminum.

One of the advantages of the alloy of the invention is that it can be produced from 3004 alloy scrap by adding manganese to the scrap to bring it up to the desired level. Moreover, the foregoing alloy of the invention can be produced from recycled beverage cans.

As stated hereinbefore, the main body of the beverage can is deep drawn and ironed to provide a bottom which is thicker than the sides. The top or lid of the can may be produced from another composition referred to as high tensile 5182 alloy containing about 5% Mg. These compositions (No. 5182 and No. 3004) can be blended together from scrap and manganese added to provide the high manganese alloy. In this case, 20 percent by weight of the 5% Mg alloy may be blended with 80 percent by weight of 3004 alloy to produce after melting a composition containing 1.8% Mg and 0.8 Mn.

However, the high manganese modified 3004 alloy, because of its improved properties, can also be used as the lid material for the cans.

The foregoing blended composition can be blended with virgin alloy material at a ratio of 66% scrap to 34% virgin material to produce the desired high manganese composition containing nominally about 1% Mg and 2 to 2.5% Mn.

Thus, one advantage of the invention is that the alloy can be produced wholly from blended scrap to which manganese is thereafter added, or, in a preferred embodiment, scrap may be blended with virgin metal.

By using the continuous sheet caster of the type described hereinbefore, the ultimate composition will have higher physical properties than the standard 3004 alloy, improved percent elongation and markedly improved microstructure.

As illustrative of the invention, the following example is given.

EXAMPLE

A modified 3004 composition is produced from a mixture of scrap and virgin metal to provide a composition containing about 0.3% Si, 0.5% Fe, 0.25% Cu, 2.3% Mn, 1% Mg and the balance essentially aluminum. A molten bath of the foregoing composition is prepared at a temperature of about 1300°F, cast between water-cooled rolls (note FIG. 1 and U.S. Pat. No. 2,790,216) to produce coiled chill cast sheet metal stock having a thickness of about ¼ inch and a width of about 24 inches.

The coiled sheet metal stock is homogenized by heating to a temperature between 950°F and 1050°F for about 8 to 16 hours to effect solution of particles of intermetallic compounds and thereafter air cooled. During air cooling, particles of intermetallic compounds precipitate out, particularly the compound based on Al-Mn, the size of the majority of the particles ranging from about 4 to 12 microns. This microstructure is desirable for deep drawing blanks.

The one-quarter inch homogenized sheet metal stock is then cold rolled to a gage of about 0.045 inch and thereafter annealed at a temperature between 650°F and 750°F for about 2 to 4 hours, the annealed sheet being thereafter cold rolled to a gage of about 0.012 to 0.0145 inch, depending upon the final gage desired. Blanks are produced from the cold rolled sheet for deep drawing into beverage cans.

As stated above, the manganese-modified type 3004 alloy exhibits improved physical properties as well as improved deep drawing characteristics. As indicative of the physical properties obtainable, cold rolled alloy of the example was stress relieved at 375°F for one hour and then tested using a tensile test coupon 1 inch wide, 8 inches long and a thickness of 0.0143 inch over a gage length of 2 inches, the necked down portion of the coupon being about 0.505 inch wide. The stress relieved coupon is compared to the as-cast properties and the properties following homogenization as follows:

| Coupon | Tensile Strength | Yield Strength | % Elong. 2 inches |
|---|---|---|---|
| (1) cold worked stress relieved | 44,800 psi | 40,000 psi | 3.5 |
| (2) homogenized | 48,200 psi | 46,700 psi | 1.0 |
| (3) as cast | 54,300 psi | 53,00 psi | 1.0 |

As will be noted, stress relief more than triples the percent elongation.

Although the present invention has been described in conjunction with preferred embodiments, it is to be understood that modifications and variations may be resorted to without departing from the spirit and scope of the invention as those skilled in the art will readily understand. Such modifications are considered to be within the purview and scope of the invention and the appended claims.

What is claimed is:

1. A method of improving the deep drawing and ironing characteristics of a type 3004 aluminum alloy in sheet form which comprises providing said alloy consisting essentially of by weight about 0.1 to 0.3% Si, about 0.25 to 0.8% Fe, about 0.1 to 0.25% Cu, about 0.75 to 1.75% Mg, with the manganese content controlled over the range of about 2 to 3% Mn and the balance essentially Al for use in the production of containers, such as beverage cans and the like which comprises, establishing a molten bath of said alloy and chill casting said alloy by passing said molten alloy bath between a pair of water-cooled rotating rolls to produce a cast sheet metal stock, heating said sheet metal stock to a temperature of about 950°F to 1050°F for a time sufficient to homogenize said alloy, air cooling said sheet metal stock to room temperature, and cold rolling said sheet metal stock to the desired gage with intermediate anneals where necessary to produce a cold rolled sheet metal product, whereby the matrix of said sheet metal product is characterized metallographically by a microstructure comprising a uniform dispersion of particles of an intermetallic compound of Al and Mn, with the majority of the particles ranging in size from about 4 to 12 microns, said sheet metal product being also characterized by improved deep drawing and ironing characteristics when die-formed into a container.

2. The method of claim 1, wherein the manganese is approximately 2.3 percent.

* * * * *